US005556183A

United States Patent [19]

Brüstle et al.

[11] Patent Number: 5,556,183

[45] Date of Patent: Sep. 17, 1996

[54] DRAWER

[75] Inventors: Klaus Brüstle, Höchst; Edgar Huber, Hard; Erich Röck, Höchst, all of Austria

[73] Assignee: Julius Blum Gesellschaft m.b.H., Höchst, Austria

[21] Appl. No.: 242,242

[22] Filed: May 13, 1994

[30] Foreign Application Priority Data

May 13, 1993 [AT] Austria ..... 947/93

[51] Int. Cl.[6] ..... A47B 88/00

[52] U.S. Cl. ..... 312/348.1; 312/330.1

[58] Field of Search ..... 312/348.1, 348.2, 312/330.1; 403/279, 282, 283

[56] References Cited

U.S. PATENT DOCUMENTS

| | | | |
|---|---|---|---|
| 4,875,747 | 10/1989 | Hollenstein | 312/330.1 |
| 5,090,786 | 2/1992 | Albice et al. | 312/330.1 |
| 5,147,123 | 9/1992 | Berger | 312/348.1 |
| 5,172,971 | 12/1992 | Albiez | 312/330.1 X |

FOREIGN PATENT DOCUMENTS

| | | | |
|---|---|---|---|
| 0429428 | 5/1991 | European Pat. Off. . | |
| 2424145 | 11/1975 | Germany . | |
| 2702217 | 7/1978 | Germany . | |
| 3600623 | 7/1986 | Germany . | |
| 8634281.9 | 2/1987 | Germany . | |
| 3805669 | 9/1988 | Germany . | |
| 3711063 | 10/1988 | Germany . | |
| 3934419 | 4/1991 | Germany . | |
| 9113477.3 | 8/1992 | Germany . | |
| 9216508.7 | 4/1993 | Germany . | |
| 2169491 | 7/1986 | United Kingdom | 312/348.1 |

*Primary Examiner*—Peter M. Cuomo
*Assistant Examiner*—Janet M. Wilkens
*Attorney, Agent, or Firm*—Wenderoth, Lind & Ponack

[57] ABSTRACT

A drawer includes drawer side walls and metal pull-out rails attached to the drawer side walls. Each metal pull-out rail has a vertical web, an upper horizontal running flange and a lower horizontal flange supporting a drawer bottom plate. The bottom plate has parallel lateral edges and a pair of longitudinal grooves extending parallel to such lateral edges. A number of flaps are punched out of each lower horizontal flange and extend into a respective groove to fix the bottom plate to the flange. Cover strips are arranged on the drawer side walls and cover the lateral edges of the bottom plate. A further number of flaps is stamped out of each lower horizontal flange. Such further flaps abut the bottom plate at the sides of the respective groove, thus thrusting the bottom plate to the respective cover strip.

9 Claims, 5 Drawing Sheets

5
17
18
4
16
15
19

1''
6
5
17
15
4
2

17
5
4
16
14

5
17
4
16
13

1''
6
5
17
14
2
4

5
1''
6
13
4
2

DRAWER

FIELD AND BACKGROUND OF THE INVENTION

The invention relates to drawer structures wherein drawer side walls have metal pull-out rails attached thereto. Each metal pull-out rail has a vertical web, an upper horizontal running flange and a lower horizontal flange supporting a respective side of a drawer bottom plate. Such bottom plate has parallel lateral edges and a pair of longitudinal grooves extending parallel to respective lateral edges. A number of flaps are punched out of each lower horizontal flange and extend into a respective groove. Cover strips arranged on the drawer side walls cover respective lateral edges of the bottom plate. The invention further provides a tool for bending the flaps.

Generally the rail that forms the pull-out rail of a pull-out assembly is attached to a side wall of a drawer. Such rails have L-, U- or Z-shaped profiles. Such rails can be separate rails or integral parts of the respective drawer side walls.

DE-OS 27 02 217 and EP-A2-0 429 428 disclose drawers with metal side walls, whereby the side walls have Z-shaped profiles and upper horizontal flanges are utilized as runner flanges for roller bearings mounted in the furniture side walls. In this way, the drawer does not need separate pull-out rails. Lower horizontal flanges of the side walls have hooks which protrude into openings such as grooves in the bottom plate.

German Utility Model 9113477 discloses a drawer side wall made of steel and including a cover strip above a flange on which the bottom plate rests, such cover strip covering a lateral edge of the bottom plate.

DE-A1-39 34 419 discloses a drawer side wall including a lower part and an upper part. The lower part has a horizontal flange on which the bottom plate rests and the upper part has a cover strip. The two parts are welded together.

Bottom plates are not always of exactly the same thickness. As a consequence, the space between the lower horizontal flange of the drawer side wall and the cover strip is chosen slightly larger than actually necessary, so that a range of tolerance regarding the thickness of the bottom plate to be mounted is obtained. Therefore, it may happen that, when the bottom plate is inserted, there is a clearance between the bottom plate and the cover strip. Dirt particles can easily accumulate in such a clearance. Especially in the case of kitchen furniture, this should be avoided.

SUMMARY OF THE INVENTION

It is the object of the invention to provide improved drawer structures of the above described type, wherein the anchoring between a bottom plate and drawer side walls is improved in such a way that the bottom plate always abuts cover strips of the drawer side walls.

According to the invention this is achieved by a further number of flaps or flap portions stamped out of the lower horizontal flange. Such further flaps or flap portions abut the bottom plate at the sides of the grooves to thus thrust the bottom plate toward the cover strips.

BRIEF DESCRIPTION OF THE DRAWINGS

In the following, embodiments of the invention will be described in more detail with reference to the accompanying drawings, in which.

DETAILED DESCRIPTION OF PREFERRED EMBODIMENTS

Figure 1:
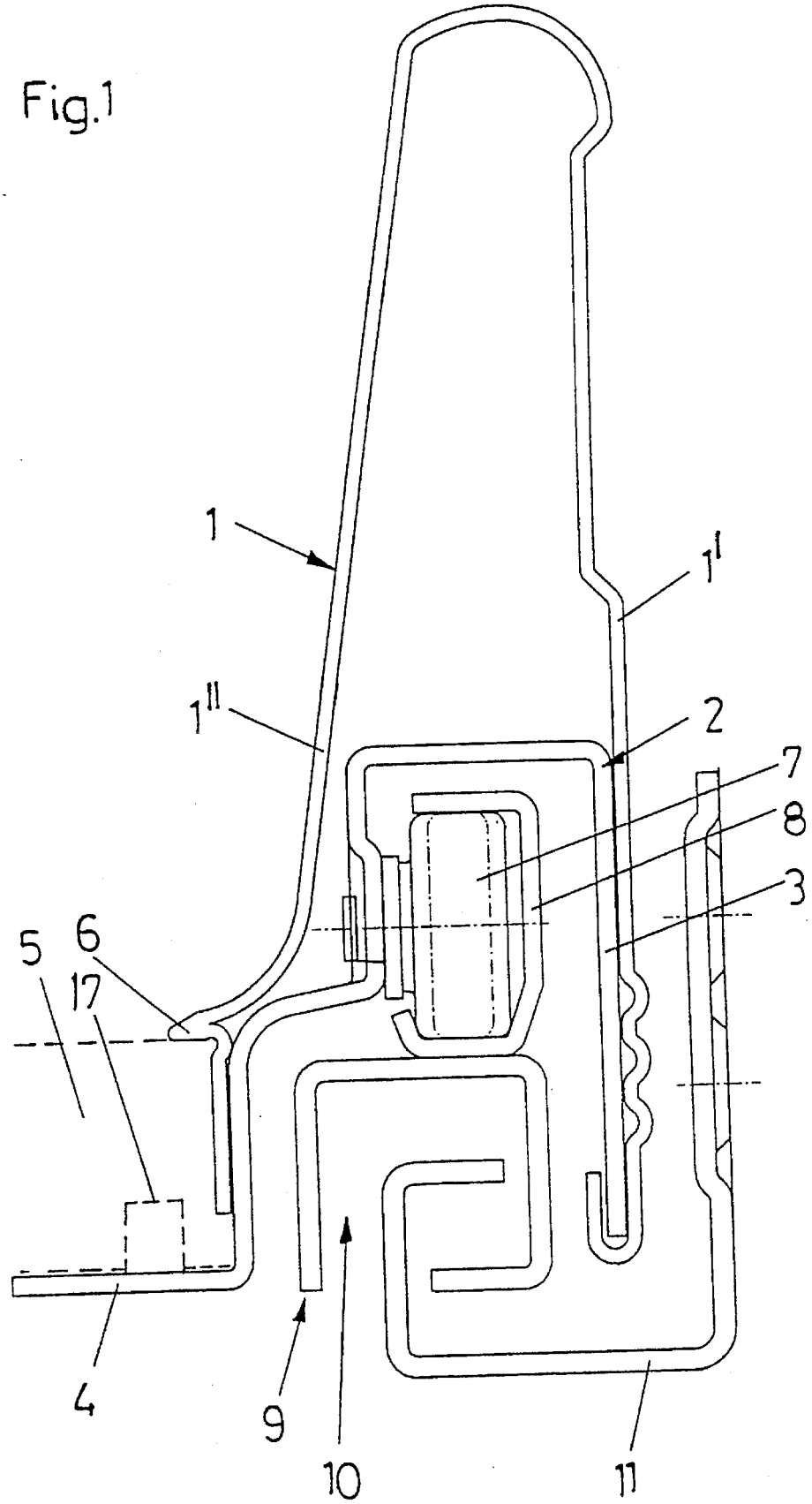
FIG. 1 is front view of a drawer side wall.

A pull-out rail 2 of a drawer guide assembly is inserted into a side wall I of a drawer. The pull-out rail 2 has a vertical web 3 which is connected an outer wall 1' of the drawer side wall 1. The pull-out rail 2 further has a horizontal flange 4 which carries a bottom plate 5 of the drawer. Inner wall 1" of the drawer side wall I has a cover strip 6 which covers a lateral edge of the bottom plate 5. A roller 7 is mounted on the pull-out rail 2. The roller 7 is guided in a profile 8 of an intermediate rail 9. The intermediate rail 9 is, by means of a roller carrier which is not shown in the drawing but which is situated in a profile 10 of rail 9, displaceable along a support rail 11 that is to be fastened to a furniture side wall.

Figure 2:
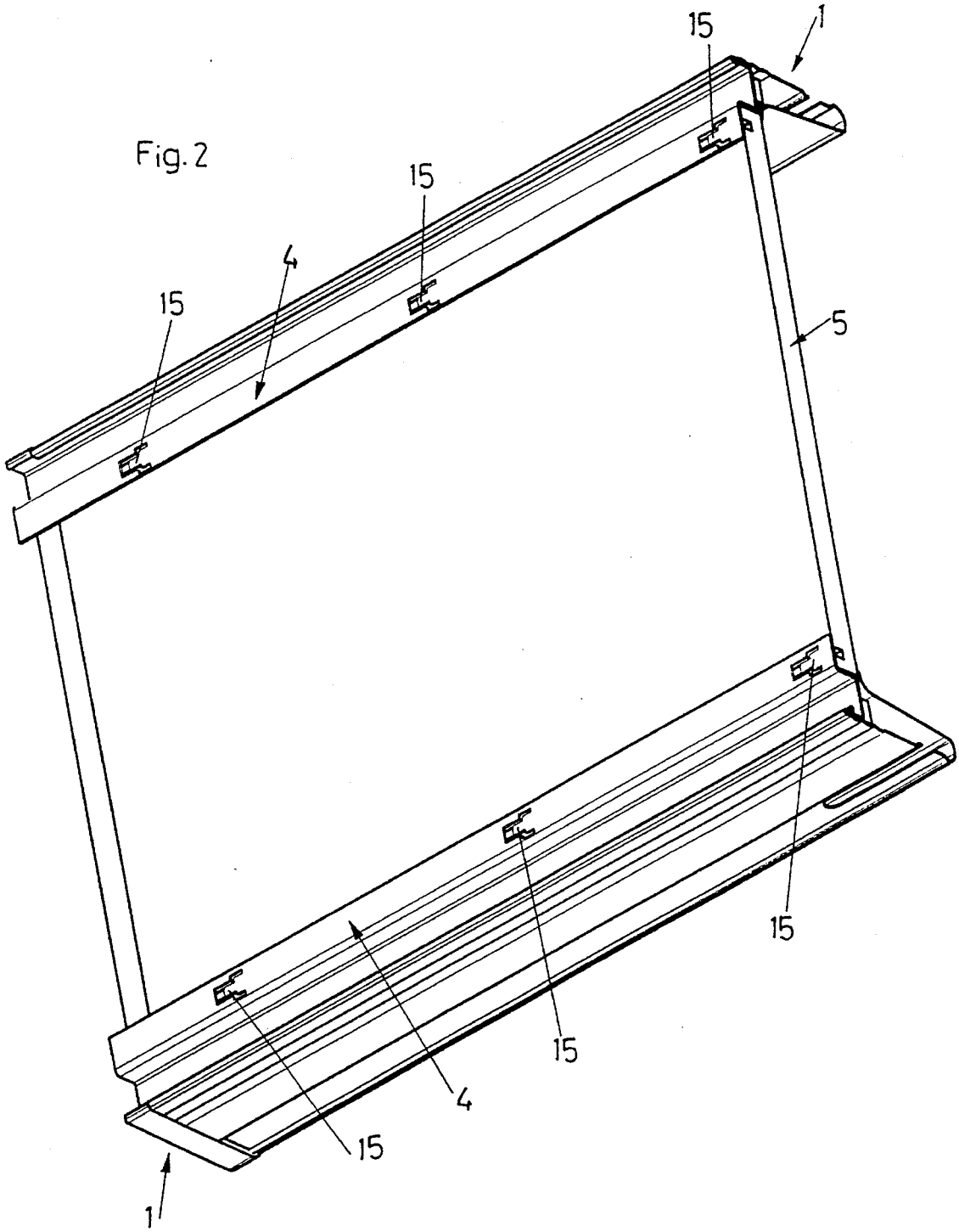
FIG. 2 is a perspective view a drawer seen from below.
Figures 3, 4, 5, 6, 7, 8:
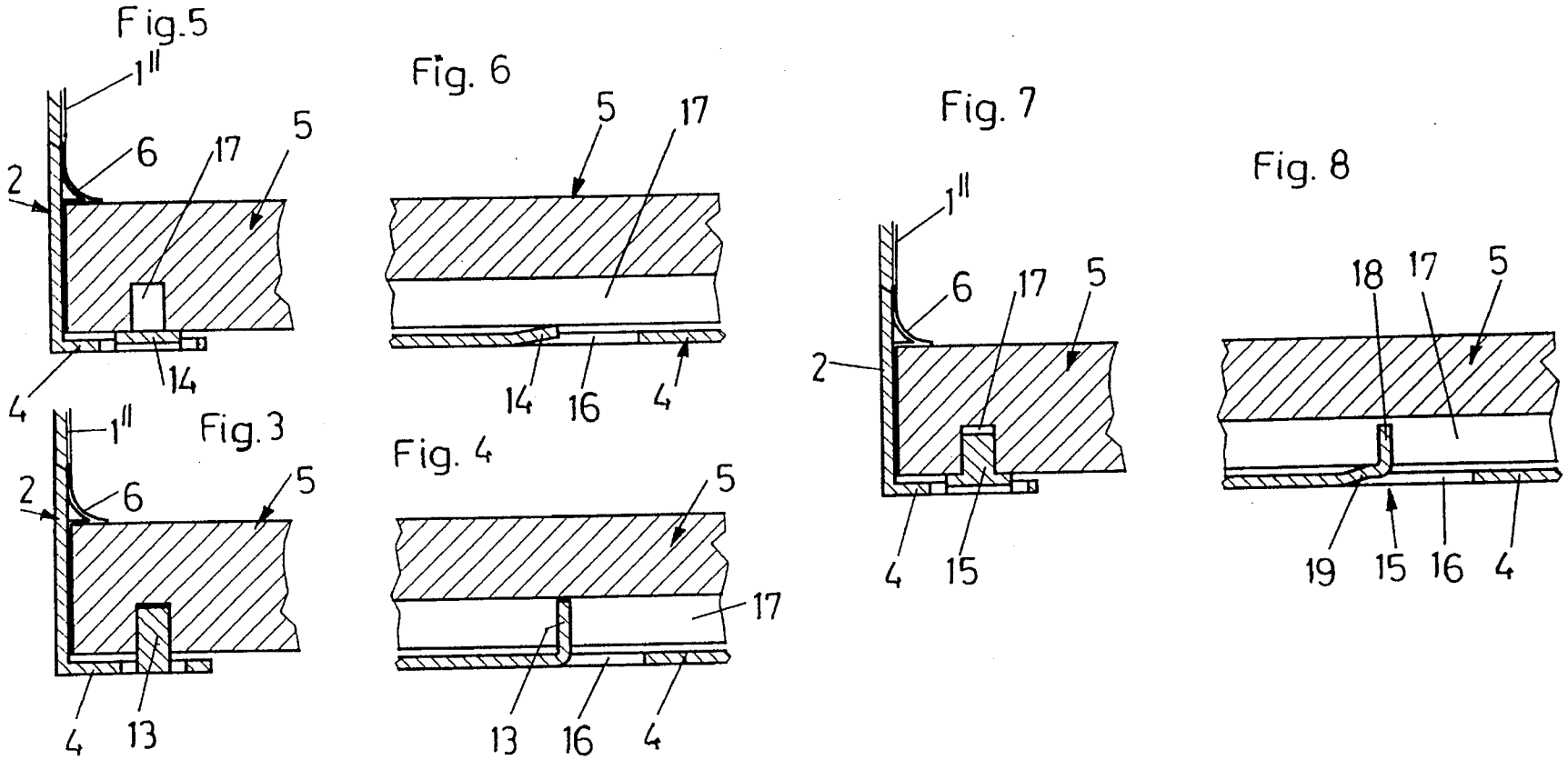
FIG. 3 is a cross section of the drawer side wall and a bottom plate in the region of a flap.
FIG. 4 is a longitudinal section of the bottom plate and a lower horizontal flange and the flap of FIG. 3.
FIG. 5 is a view similar to FIG. 3 but in the region of another flap.
FIG. 6 is a view similar to FIG. 4 but of the flap of FIG. 5.
FIG. 7 is a view similar to FIG. 3 but according to another embodiment of the invention.
FIG. 8 is a view similar to FIG. 4 but of the flap according to FIG. 7.
Figure 11A:
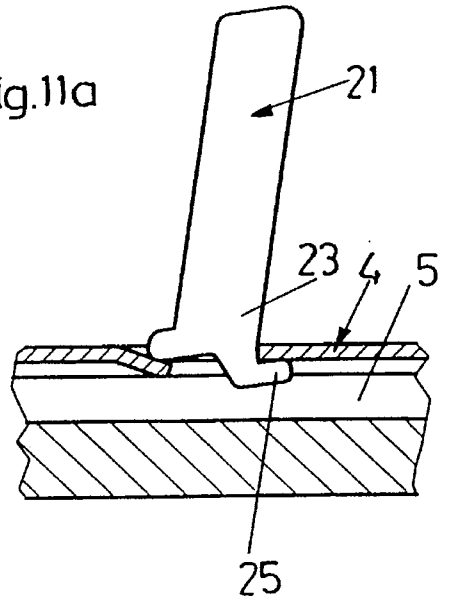
FIG. 11*a* is a view similar to FIG. 10*a* but with the tool operable on the flap of FIG. 5.
Figure 11B:
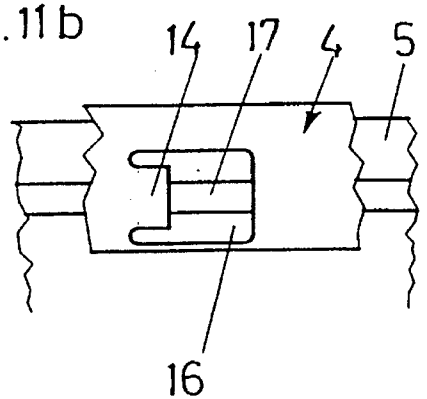
FIG. 11*b* is a view from the bottom of FIG. 11*a*.
Figure 10A:
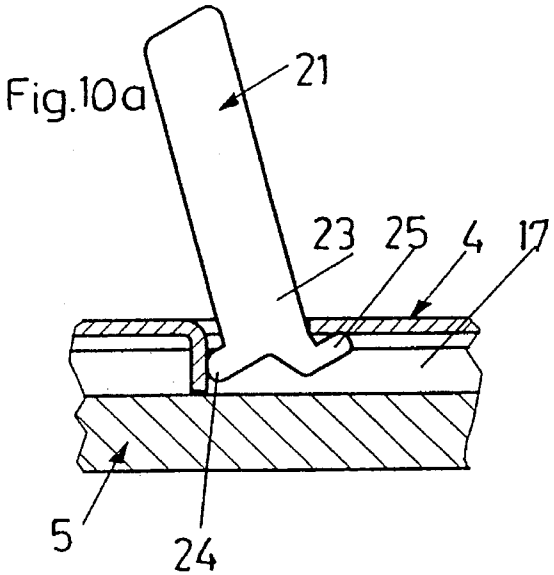
FIG. 10*a* is a view similar to FIG. 9*a* but showing the tool when the flap of FIG. 3 is forced into a groove of the bottom plate.
Figure 10B:
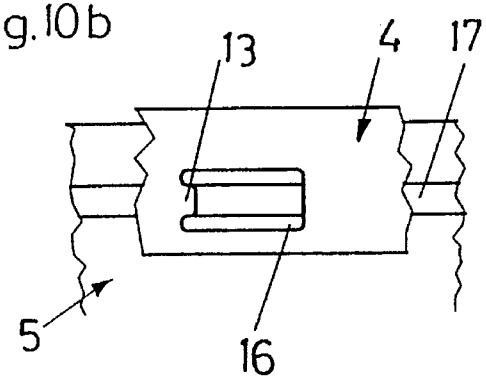
FIG. 10*b* is a view from the bottom of FIG. 10*a;*
Figure 9A:
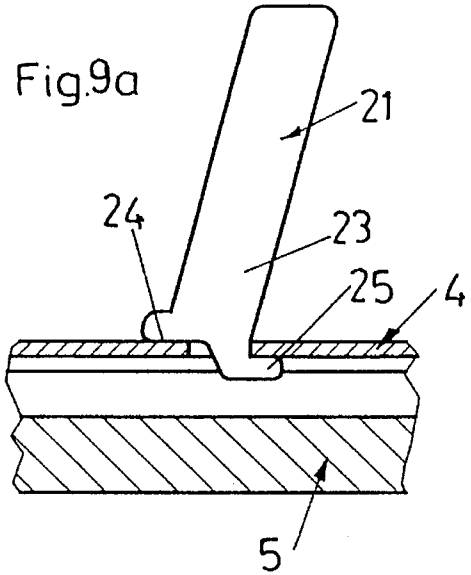
FIG. 9*a* is a longitudinal section of the bottom plate and the lower horizontal flange and showing an inserted tool in a fist phase of attaching the bottom plate to the flange.
Figure 9B:
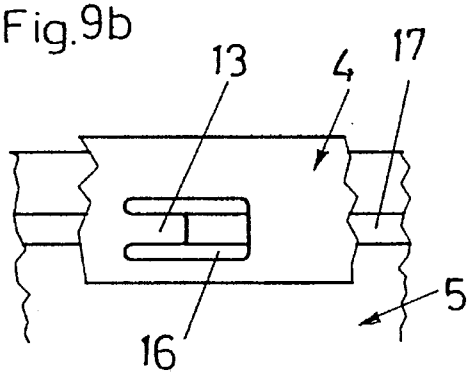
FIG. 9*b* is a view of the horizontal flange of the drawer side wall of FIG. 9*a* from below.
Figure 12A:
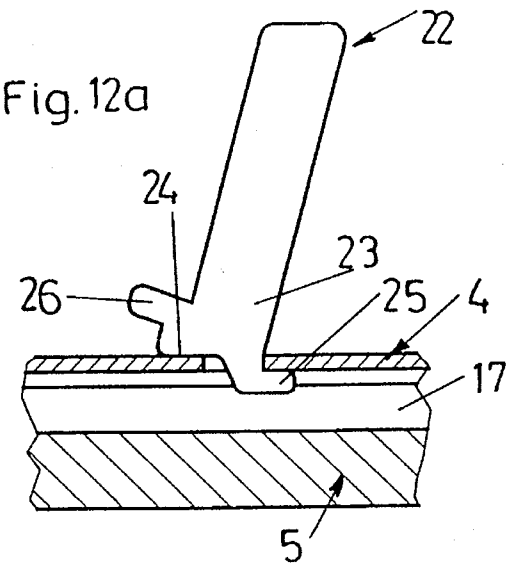
Figure 12B:
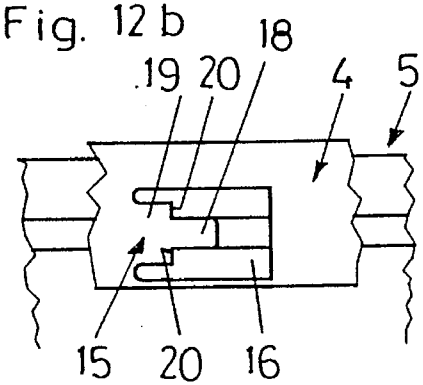

As can be seen in FIGS. 2 to 12*b*, flaps 13 and 14 or 15 are punched out of the horizontal flange 4 of the pull-out rail 2. The flaps 13, 14, 15 are situated in respective punch holes 16 of the horizontal flange 4 of the pull-out rail 2. The bottom plate 5 is provided at each side thereof with a continuous groove 17.

When assembling the drawer, the bottom plate 5 is placed on the horizontal flanges 4 of the pull-out rails 2, or the drawer parts are turned around and the pull-out rails 2 are placed on the bottom side of the bottom plate 4.

In the embodiment of FIGS. 3–6 and 9*a*–11*b*, the flaps 13 form first flap portions that are used for rigidly connecting the bottom plate 5 and the pull-out rails 2. The width of the flap 13 is such that the flap 13 can be pressed into the groove 17. Further flaps 14 form second flap portions that are provided to prevent a clearance from existing between the bottom plate 5 and the cover strip 6 when the bottom plate 5 is mounted on the pull-out rails 2. Preferably, the flaps 13, 14 are positioned alternately with respect to each other along the horizontal flange 4. The flaps 14 are broader than the grooves 17. When they are bent out of the horizontal flange 4 they do not protrude into the groove 17 but are pressed onto the bottom of the bottom plate 5 on both sides of groove 17 so that the bottom plate 5 is pressed to the cover strip 6. When the bottom plate 5 rests on the cover strip 6, the bottom plate is secured by means of the flaps 13, which are provided with points or projections which are pressed into the side walls of the groove 17.

Figure 14A:
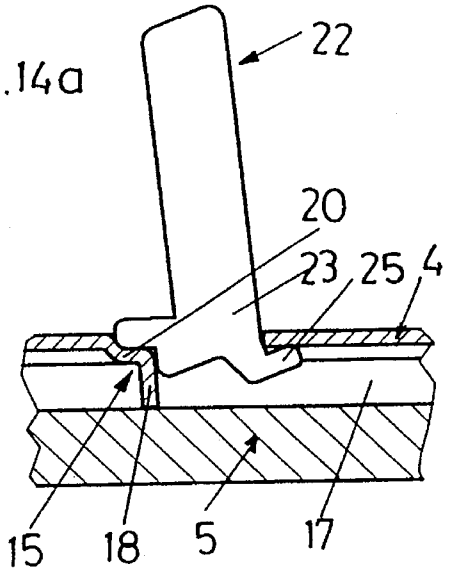
FIGS. 12*a*–14*b* are viewed respectively similar to FIGS. 9*a*–11*b*, but illustrating operation of another tool for deforming the flange of FIGS. 7 and 8.
Figure 14B:
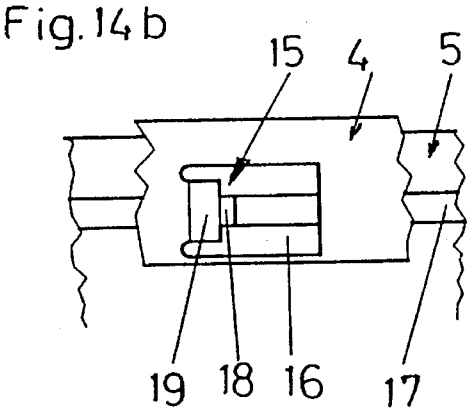
Figure 13A:
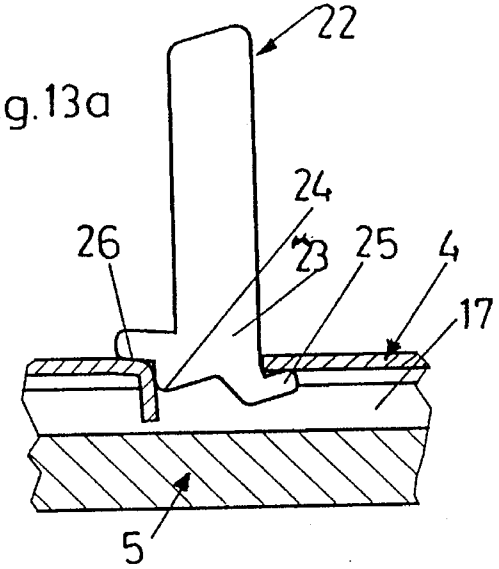
Figure 13B:
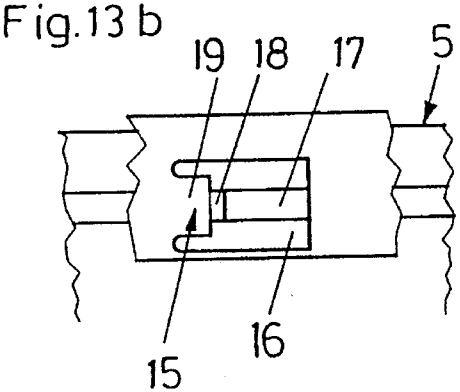

In the embodiment of FIGS. 7, 8 and 12*a*–14*b*, only flaps 15 are punched out of the horizontal flange 4 of the pull-out rail 2. Each flap 15 has a narrow front part 18 forming a first flap portion. The narrow part 18 is as broad as the flap 13 of the previous embodiment, so that the part 18 can protrude into the groove 17 when the flap 15 is bent towards the bottom plate 5. A rear part 19 of the flap 15 forms a second flap portion and is broader than part 18 and corresponds to the flap 14 of the previous embodiment, so that front edges of the part 19 will press on the bottom plate 5 on both sides of the groove 17.

A tool 21 or 22 is used to bend the flaps 13 and 14 or 15, respectively. As shown in FIGS. 9*a*–11*b*, the tool 21 has a flat arm 23, which can be inserted into the punch hole 16 in the horizontal flange 4 of the pull-out rail 2. The arm 23 has on one side thereof a press edge 24 which presses on the flaps 13 or 14. On the other side of the arm and staggered longitudinally of arm 23 with respect to the press edge 24 is provided a hook 25. The hook 25 reaches through the punch hole 16 and is hooked on the opposite surface of horizontal flange 4 so that the tool 21 braces against the pull-out rail 2 when the flaps 13 or 14 are bent out of the horizontal flange 4.

For bending the flap 15 (the embodiment of FIGS. 12*a*–14*b*), the tool 22 has on one side of arm 23 two press edges, i.e. a press edge 24 and a press edge 26. While the press edge 24 abuts the front part 18 of the flap 15 and presses the part 18 into the groove 17, the press edge 26 bears on to the rear part 19 of the flap 15 and presses part 19 to the bottom side of the bottom plate 5. In this way, the bottom plate 5 is pressed to the cover strip 6 and secured by means of the part 18 being driven into the groove 17 in one working operation.

It is within the scope of the invention that the horizontal flange 4 as well as the cover strip 6 are formed directly on inner wall 1" of the drawer side wall 1.

We claim:

1. A drawer assembly comprising:

a drawer side wall having a cover strip;

a metal pull-out rail rigid with said side wall, said rail having a lower horizontal flange;

a drawer bottom plate supported on said flange with a lateral edge of said bottom plate being covered by said cover strip, said bottom plate having in a bottom thereof a longitudinal groove;

a plurality of first and second flap portions integral with said flange and punched from the material thereof, said flap portions being aligned rectilinearly along said flange;

each said first flap portion being bent toward said bottom plate and having a width in a direction transverse to a longitudinal dimension of said flange such that said first flap portion fits into said groove in said bottom plate; and each said second flap portion being bent toward said bottom plate and having a width in said direction that is greater than said width of said first flap portion, such that said second flap portion abuts said bottom plate without fitting into said groove and thus urges said bottom plate toward said cover strip.

2. An assembly as claimed in claim 1, wherein said first flap portions and said second flap portions each comprise respective separate individual flaps punched from said material of said flange.

3. An assembly as claimed in claim 2, wherein said first and second flap portions are positioned alternately along said flange.

4. An assembly as claimed in claim 1, wherein said first and second flap portions are positioned alternately along said flange.

5. An assembly as claimed in claim 1, wherein a said first flap portion and a said second flap portion are formed together on a single flap punched from said material of said flange.

6. An assembly as claimed in claim 5, wherein said first flap portion comprises a narrow front part of said flap, and said second flap portion comprises a wide rear part of said flap, said rear part having lateral edges extending from opposite sides of said front part.

7. An assembly as claimed in claim 1, wherein each said flap portion is within an opening punched from said material of said flange.

8. An assembly as claimed in claim 7, wherein each said opening has a length in said longitudinal dimension of said flange that is greater than a length of the respective said flap portion in said longitudinal dimension, thereby defining a gap between a free end of said flap portion and a confronting edge of said flange.

9. An assembly as claimed in claim 1, wherein said side wall is formed of metal in one piece with said rail.

* * * * *